US005448791A

United States Patent [19]

Brown

[11] Patent Number: 5,448,791

[45] Date of Patent: Sep. 12, 1995

[54] SUPPORT MECHANISM FOR A BED

[76] Inventor: David J. Brown, 289 Chesterfield Rd., Westhampton, Mass. 01027

[21] Appl. No.: 59,096

[22] Filed: May 10, 1993

[51] Int. Cl.[6] ..... A47C 19/02

[52] U.S. Cl. ..... 5/662; 5/425; 5/503.1; 5/658

[58] Field of Search ..... 5/425, 426, 503.1, 658, 5/662

[56] References Cited

U.S. PATENT DOCUMENTS

| | | | |
|---|---|---|---|
| 1,797,847 | 3/1931 | Vandagriff . | |
| 2,557,538 | 6/1951 | Greensfelder | 5/425 |
| 2,567,047 | 9/1951 | Arliss | 5/425 |
| 2,593,567 | 4/1952 | Keck . | |
| 2,648,850 | 8/1953 | Warren | 5/425 |
| 2,664,576 | 1/1954 | Lehman | 5/425 |
| 2,712,137 | 7/1955 | Hunter . | |
| 3,863,282 | 2/1975 | Stillwell . | |
| 5,231,721 | 8/1993 | Fish | 5/662 |
| 5,257,426 | 11/1993 | Leoutsakos . | |

FOREIGN PATENT DOCUMENTS

| | | |
|---|---|---|
| 2500743 | 3/1982 | France . |
| 1006956 | 10/1965 | United Kingdom . |
| 82/02832 | 9/1982 | WIPO . |

*Primary Examiner*—Michael F. Trettel
*Attorney, Agent, or Firm*—Steven N. Fox

[57] ABSTRACT

Disclosed is a support mechanism that may be installed onto a conventional bed to assist a person into and out of a bed. The support mechanism comprises a tubular support member formed with a pair of vertical and substantially parallel legs, each of which is adapted to fasten to the vertical extending portion of a side rail. The support mechanism may further comprise a clamp which is adapted to connect one of the legs to the bed post.

12 Claims, 2 Drawing Sheets

SUPPORT MECHANISM FOR A BED

FIELD OF THE INVENTION

The present invention relates generally to support mechanisms and more particularly, to a mechanism for assisting a person into and out of a bed.

BACKGROUND OF THE INVENTION

For a variety of reasons, many people have difficulty getting into and out a conventional bed. For example, it is not uncommon for elderly persons to use an apparatus commonly referred to as a "walker" to move from one room of the house to another. When the person desires to get into a conventional bed, the person typically positions the "walker" adjacent to the bed and attempts to place themselves onto the bed by using the walker as a support. Quite often, however, the walker will move when the person applies their weight to the walker thus making the process of getting into bed difficult and dangerous.

U.S. Pat. No. 5,195,200 discloses a support apparatus which is mounted to the bottom surface of rails 13 and 14 of a conventional bed frame 10 by a plate 20, clip members 28, and screws 26. The apparatus further employs a tubular member 22 connected to and positioned adjacent to plate 20 and which is adapted to receive a variety of support tubes.

While providing some degree of support to a person getting into and out of bed, apparatus of the type disclosed by U.S. Pat. No. 5,195,200 have several drawbacks. First, such support apparatus might not support even moderate loads without bending thereby failing to provide a solid support for persons getting into and out of bed. Furthermore, the support apparatus has numerous components which makes it cumbersome to mount to the bed frame insomuch as it fastens to the bottom surface of two bed rails and secured by multiple clamps and screws.

SUMMARY OF THE INVENTION

The present invention is a support apparatus that can be easily attached to a conventional bed to provide a rigid support structure which may be used by a person to get into and out of the bed. The support apparatus generally comprises a tubular support member formed to have two legs which are attached by a bracket to the side rails of the bed. The support apparatus may further comprise a clamp designed to secure one of the legs of the support member to the bed post. The present invention overcomes the drawbacks associated with conventional support apparatus for beds in that it provides a solid and rigid support structure so that a person may confidently apply their weight to the support structure as they get into and out of the bed. Moreover, unlike conventional devices, the support apparatus of the present invention can be easily installed onto a conventional bed.

BRIEF DESCRIPTION OF THE DRAWINGS

The following detailed description will become better understood with reference to the accompanying drawings in which.

DETAILED DESCRIPTION OF THE PREFERRED EMBODIMENTS

Figure 1:
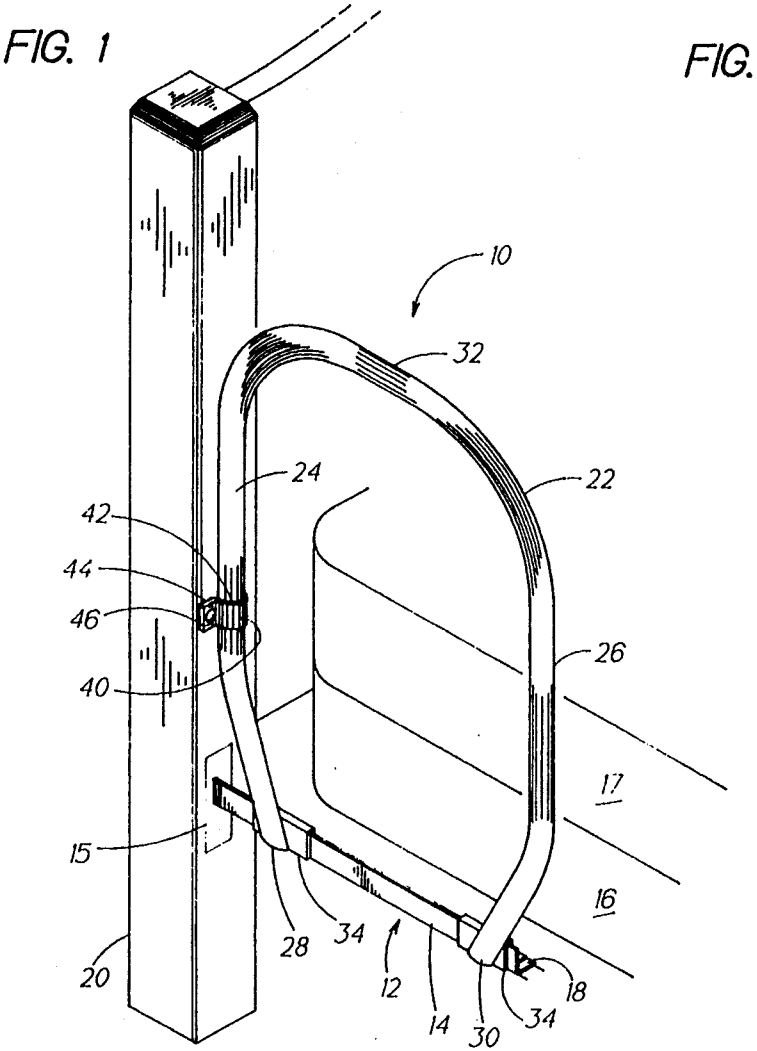
FIG. 1 is a perspective view showing one embodiment of the support apparatus of the present invention mounted to a conventional bed frame.
Figure 2:
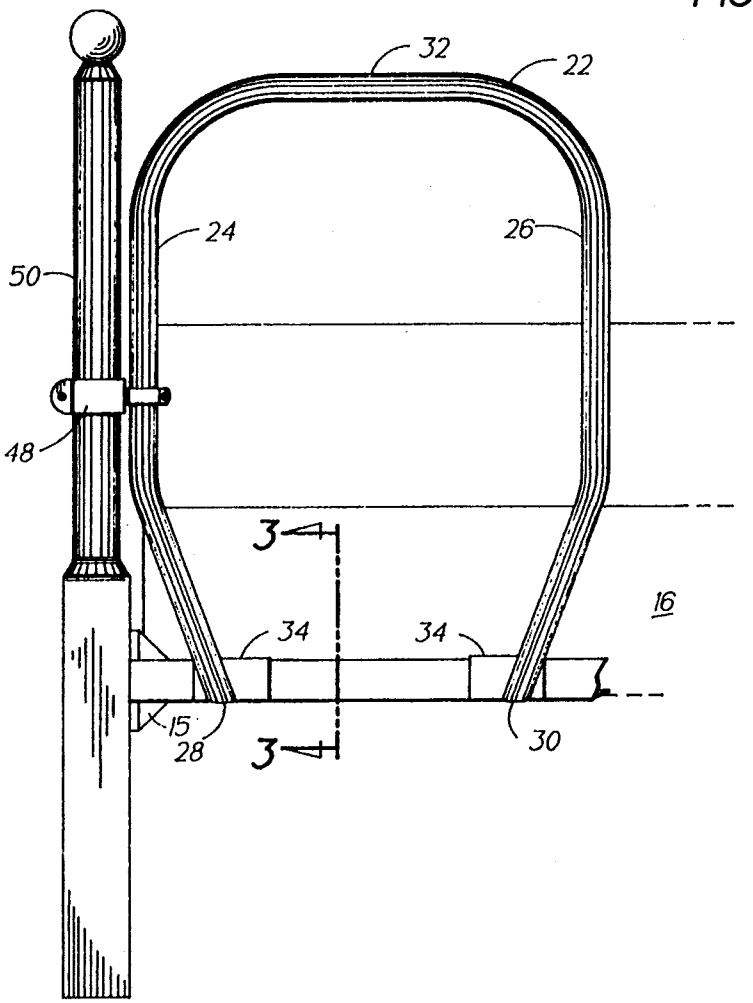
FIG. 2 is a perspective view showing a second embodiment of the support apparatus of the present invention mounted to a conventional bed frame.
Figure 3:
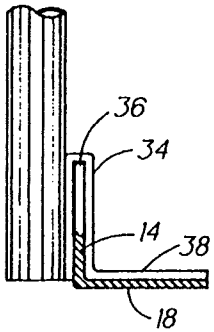
FIG. 3 is a cross-section view taken along line 3—3 of FIG. 2.

Referring to FIGS. 1–3, one embodiment of the support apparatus 10 of the present invention is shown mounted to a conventional bed frame generally consisting of a side rail 12 having a vertical portion 14 and a horizontal portion 18 attached to a bed post 20 by a bracket 15. Also shown are mattresses 16 and 17 which would normally rest on horizontal portion 18 of side rail 12.

The support apparatus 10 generally comprises a tubular member 22 formed by conventional bending operations to have vertically extending and substantially parallel legs portions 24 and 26 with ends 28 and 30, respectively, which are bent inwardly about 30 degrees from each corresponding leg, and a top portion 32. By bending ends 28 and 30 inward, brackets 34 (to be described) are offset from the legs portions 24 and 26 which allows the leg portions 24 or 26 to be affixed to the best post 20 without any interference with support bracket 15. Tubular member 22 has an outside diameter of 1.0 inch and may be made from mechanical tubing.

The support apparatus 10 further comprises a bracket 34 rigidly connected to each of ends 28 and 30 of leg portions 24 and 26 and which is adapted to connect the support apparatus 10 to the side rail 12. As shown in FIG. 3, the bracket 34 comprises a downward and vertically extending channel 36 adapted to securely engage with the vertical portion 14 of side rail 12. The bracket 34 further comprises a horizontal portion 38 extending from the lower end of the channel 36 which is adapted to engage with horizontal portion 18 of side rail 12. The depth of channel 36 relative to the position of horizontal portion 38 should be sufficient to ensure that the upper portion of channel 36 will not engage with the upper portion of vertical portion 14 in a manner that would prevent horizontal portion 38 from engaging with the horizontal portion 18. Further, the horizontal portion 38 should be of sufficient length such that it will extend substantially the full length of horizontal portion 18 of side rail 12 so that a mattress 16 when placed onto bed frame 12 will provide additional support to brackets 34 and thus tubular member 22.

As shown in FIG. 1, the support apparatus 10 further comprises a clamp 40 adapted to securely mount the leg portion 24 to the bed post 20. In the embodiment of FIG. 1, the clamp 40 has a semi-circular portion or cavity 42 which is adapted to receive and capture the leg portion 24, and a flat portion 44 having an opening 46 which is fastened by screws (not shown) to bed post 20.

Figure 7:
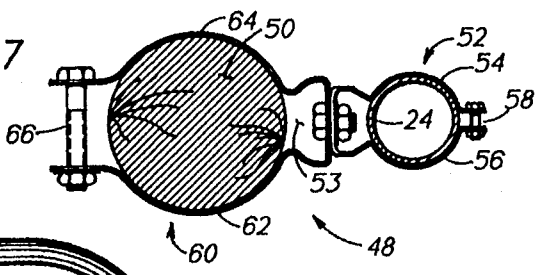
FIG. 7 is a cross-section view taken along line 7—7 of FIG. 5.

As shown in FIG. 2, clamp 40 may be replaced with a clamp 48 adapted to securely mount the leg portion 24 to a cylindrical shaped bed post 50. As shown in FIG. 7, the clamp 48 comprises a first portion 52 and a second portion 60 securely engaged to each other by bolt/nut combination 53. First portion 52 comprises semi-cylindrical sides 54 and 56 adapted to fit around and capture leg 24. Sides 54 and 56 are secured together by means of a bolt/nut combination 58. The clamp 48 further comprises a second portion 60 having semi-cylindrical sides 62 and 64 adapted to fit around and capture the post 50. Sides 62 and 64 are secured together by means of a bolt/nut combination 66.

Figure 6:
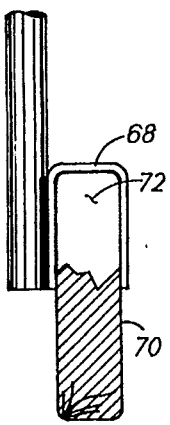
FIG. 6 is a cross-section view taken along line 6—6 of FIG. 5.
Figure 5:
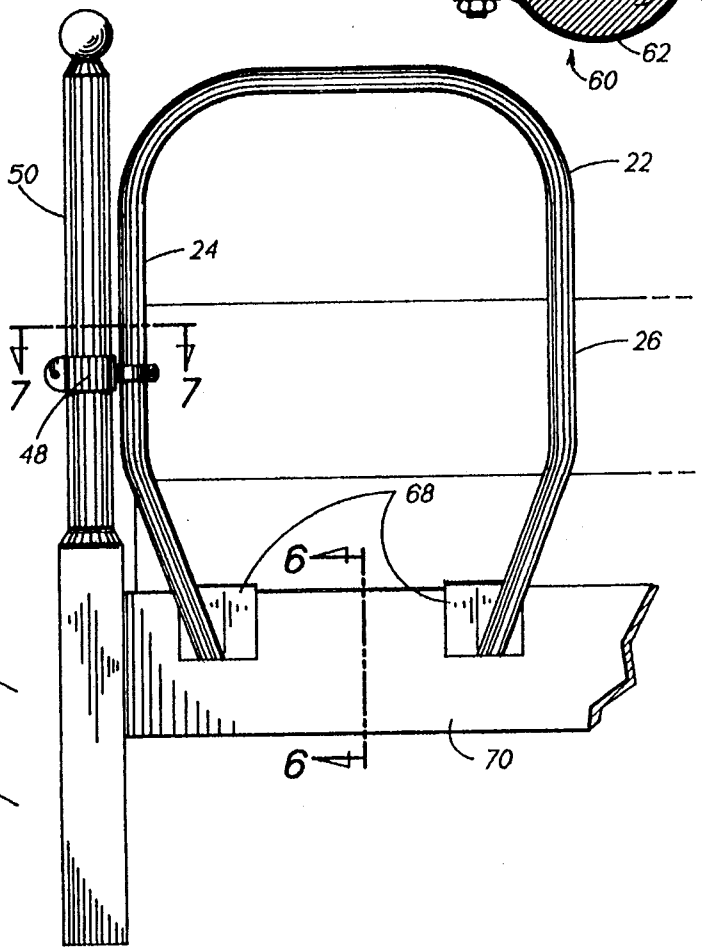
FIG. 5 is a perspective view showing a fourth embodiment of the support apparatus of the present invention mounted to a conventional bed frame.
Figure 4:
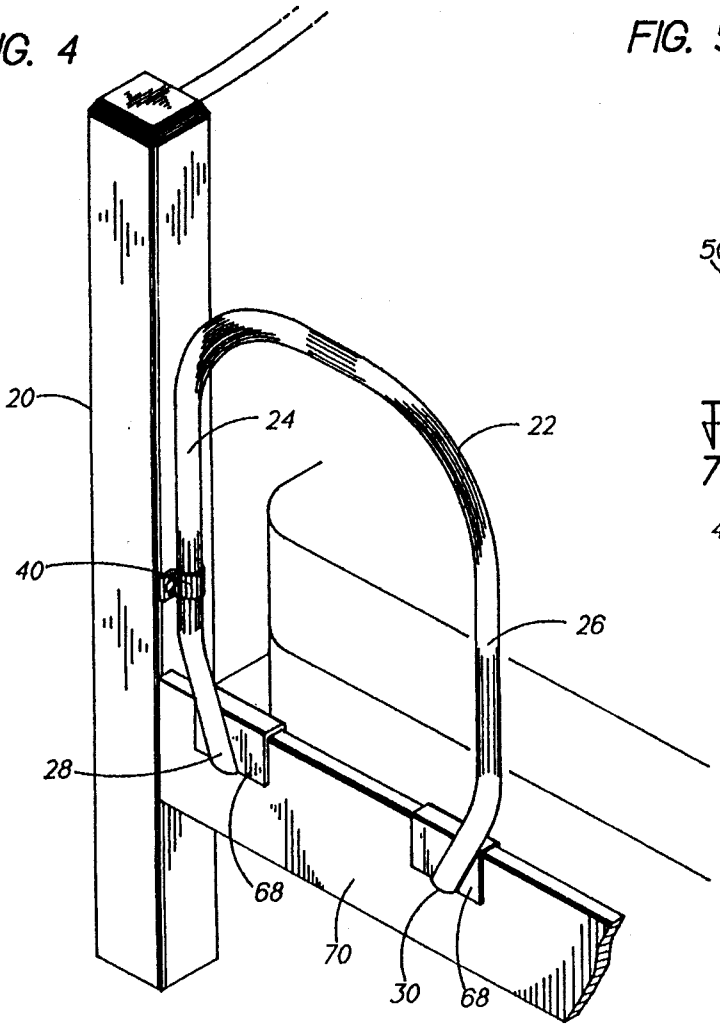
FIG. 4 is a perspective view showing a fourth embodiment of the support apparatus of the present invention mounted to a conventional bed frame.

As shown in FIGS. 4–5, the bracket 34 of both the embodiments of FIGS. 1 or 2, may be replaced with a bracket 68 which is adapted to mount to a bed frame consisting of a vertically extending side wall 70. In these types of bed frames, the side wall 70 has a thickness considerably larger than the thickness of vertical portion 14 of side rail 12. As such, bracket 68, unlike bracket 34, may be formed with only a channel 72 (FIG. 6) adapted to securely engage with side wall 70. The size of channel 72 and side wall 70 are large enough to provide adequate support to tubular member 22.

Although not shown in the drawings, the support apparatus may be configured with an additional mounting member connected to one or both of legs 24 and 24 and which extends outwardly therefrom such that it can be placed between mattresses 16 and 17. This mounting configuration which provides substantial support to tubular member 22 thereby eliminating the need to have one of legs connected to the bed post.

The foregoing description has been for illustrative purposes only. As will be obvious to one skilled in the art, the present invention may be readily modified without departing from the spirit and scope of the invention as defined by the following claims.

What is claimed:

1. A support mechanism for assisting a person into and out of a bed having a frame including vertically and horizontally extending portions of a side rail and a head post, the support mechanism comprising: a support member having an upper portion and first and second legs, a bracket welded to each of said first and second legs such that said first and second legs are removably attached to the vertical extending portion of the side rail, and a clamp adapted to attach said first leg to the bed post.

2. The support mechanism of claim 1, wherein said each of said first and second legs comprises an intermediate portion.

3. The support mechanism of claim 2, wherein said clamp engages with said intermediate portion of said first leg.

4. The support mechanism of claim 3, wherein said intermediate portion of said first leg is displaced from said bracket of said first leg so that said clamp may attach said intermediate portion of said first leg to the bed post.

5. The support mechanism of claim 1, wherein each of said brackets comprises a channel adapted to engage with the vertical extending portions of the side rail.

6. The support mechanism of claim 5, wherein each of said brackets further comprise a substantially horizontal portion configured to engage with the horizontally extending portion of the side rail.

7. A support mechanism for assisting a person into and out of a bed having a frame including vertically and horizontally extending portions of a side rail and a head post, the support mechanism comprising: a support member having an upper portion and first and second legs each comprising an intermediate portion, a bracket attached to each of said first and second legs such that said first and second legs are removably attached to the vertical extending portion of the side rail, and a clamp adapted to attach said intermediate portion of said first leg to the bed post.

8. The support mechanism of claim 7, wherein each of said brackets comprises a channel adapted to removably mount about the vertical extending portion of the side rail.

9. The support mechanism of claim 8, wherein each said channel is integrally formed with said bracket.

10. The support mechanism of claim 8, wherein each of said brackets is integrally formed with each of said first and second legs.

11. The support mechanism of claim 7, wherein said intermediate portion of said first leg is displaced from said bracket of said first leg so that said clamp may attach said intermediate portion of said first leg to the bed post.

12. The support mechanism of claim 7, wherein said each of said brackets further comprise a substantially horizontal portion configured to engage with the horizontally extending portion of the side rail.

* * * * *